US006163241A

United States Patent [19]

Stupak, Jr. et al.

[11] Patent Number: 6,163,241

[45] Date of Patent: Dec. 19, 2000

[54] COIL AND METHOD FOR MAGNETIZING AN ARTICLE

[76] Inventors: Joseph J. Stupak, Jr., 7102 SW. 10th Ave., Portland, Oreg. 97219; Jack L. Hoffman, 3170 S. Goodtime Pl., Mollala, Oreg. 97038

[21] Appl. No.: 09/387,279

[22] Filed: Aug. 31, 1999

[51] Int. Cl.[7] ..... H01F 5/00

[52] U.S. Cl. ..... 335/300; 335/216; 505/892

[58] Field of Search ..... 335/216, 296–300, 335/284; 505/892–897

[56] References Cited

U.S. PATENT DOCUMENTS

| | | | |
|---|---|---|---|
| 2,819,431 | 1/1958 | Maxwell . | |
| 2,854,608 | 9/1958 | McGuire et al. . | |
| 3,501,727 | 3/1970 | Kafka . | |
| 3,766,502 | 10/1973 | Bronca et al. . | |
| 3,801,942 | 4/1974 | Elsel . | |
| 4,166,990 | 9/1979 | Kassner . | |
| 4,333,228 | 6/1982 | Koch | 29/599 |
| 4,477,790 | 10/1984 | Moritz . | |
| 4,529,955 | 7/1985 | Schuster et al. | 335/300 |
| 4,593,261 | 6/1986 | Forster et al. | 335/300 |
| 5,852,393 | 12/1998 | Reznik et al. | 335/284 |

*Primary Examiner*—Lincoln Donovan

[57] ABSTRACT

A coil for magnetizing an article. The coil includes a cooling coil component and an electric coil component. An elongate electric coil component is placed with its center along a bobbin, wherein one end is wound in one direction around the bobbin and the other end in the other direction. The cooling coil component includes a disk-like member in which a passage is formed for carrying a fluid coolant. The disk-like member is "C" shaped to substantially prevent the flow of eddy currents. Electric coil components disposed at the ends of the coil are provided with a greater number of windings to make the magnetic field in the coil more uniform.

12 Claims, 4 Drawing Sheets

Fig. 2
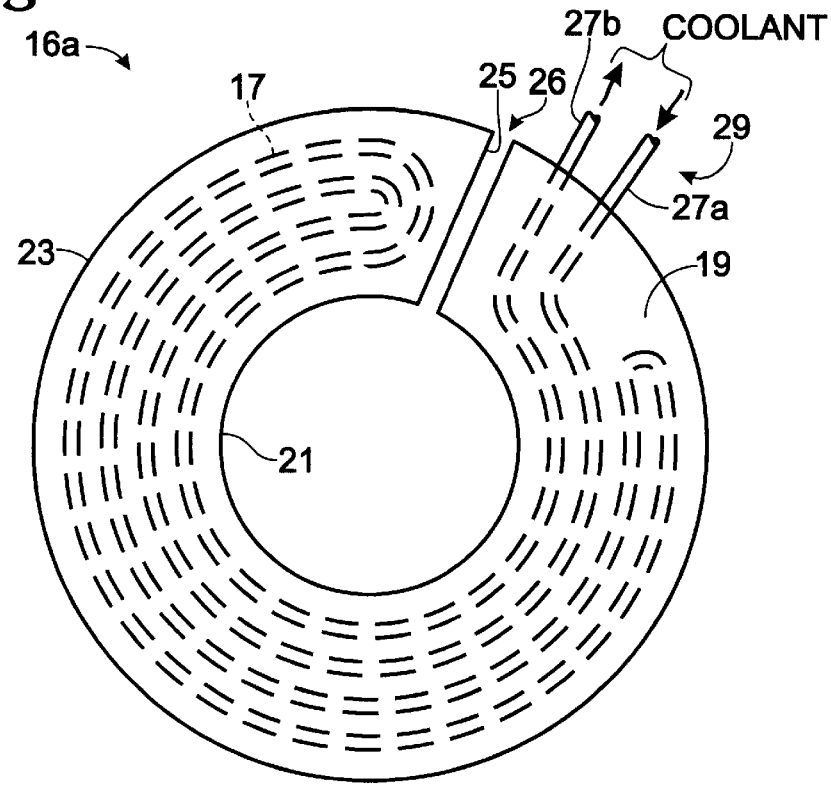
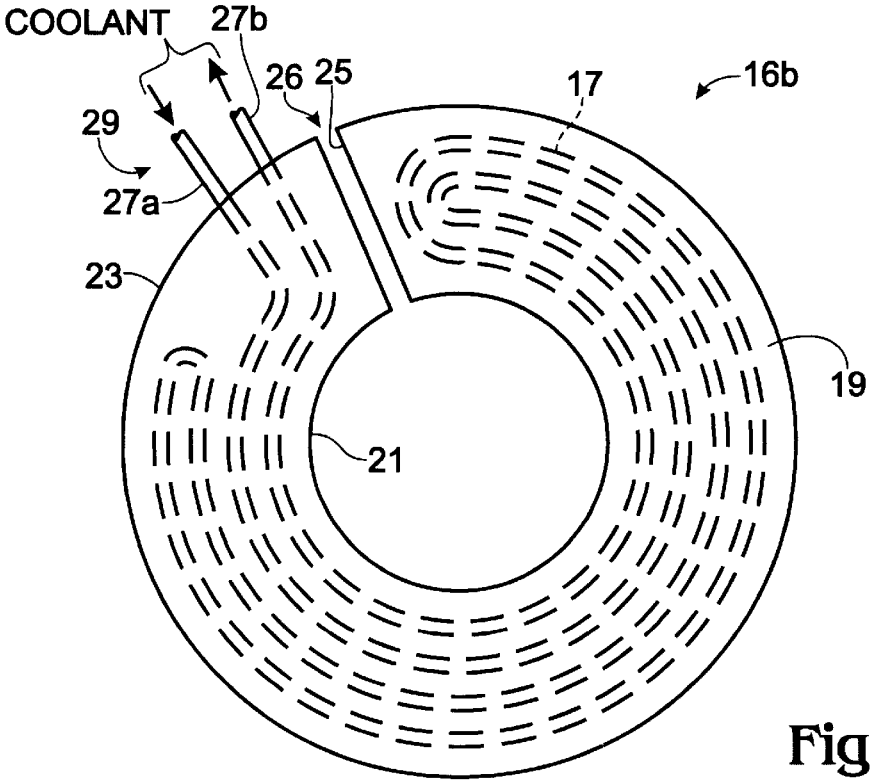
Fig. 3

COIL AND METHOD FOR MAGNETIZING AN ARTICLE

BACKGROUND OF THE INVENTION

The present invention relates to a coil and method for magnetizing an article, particularly an electromagnetic coil method and apparatus for magnetizing an article employing relatively high magnetic fields.

Electromagnetic coils have long been employed for creating the magnetic fields necessary to magnetize an article comprising a permanently magnetizable material. Such material has as one of its material properties a coercive force that must be reached or exceeded by action of the coil in order to permanently magnetize the material.

In typical practice, the magnetic fields required to be produced by the coil are of such strength that substantial physical stress is imposed on the coil. This results from the Lorentz force between the moving electron charges that form the electrical current in the coil and the magnetic field produced thereby. The Lorentz force produces a radial stress on the coil as well as a consequent shrinking thereof along the longitudinal axis. The Lorentz force is proportional to the product of the velocity of the charges and the magnitude of the magnetic field. The velocity of the charges is proportional to the current which is also proportional to the magnetic field, therefore, the Lorentz force is proportional to the square of the magnetic field the coil produces. Accordingly, as the magnetic field is increased, the Lorentz force becomes disproportionately larger and the stress on the coil in practice is often on the order of thousands of pounds per square inch.

The coil also produces heat in proportion to the time integral of the square of the current it carries. If uncontrolled, this heat may destroy electrical insulation on the coil or even melt or vaporize it. To carry off this heat, coiled tubes adapted to carry a coolant such as water are typically wrapped around the outside of the electric coil. In addition, to restrain the coil against the aforementioned radial stresses, the coil is typically wrapped circumferentially with a strong jacketing material, such as a glass or aramid fiber tape. However, the jacket material also tends to be thermally insulative. Therefore, if the jacketing material is placed between the electric coil and the coiled tubes, transfer of heat is made less effective. If, on the other hand, the jacketing material is placed outside both the electric coil and the coiled tubes, the coiled tubes are subjected to being crushed between the electric coil and the relatively unyielding jacketing. Providing for effective cooling in the presence of large mechanical stresses has generally meant that structures adapted for carrying coolant are constructed to be very strong. As an example, Schuster et al., U.S. Pat. No. 4,529,955 proposes machining cooling channels in a stiff washer-like member. This type of construction has the disadvantage of being relatively expensive.

Another problem encountered in the design of a coil for magnetizing an article results from the need to avoid inducing voltages and currents in the, typically, electrically conductive material of which the cooling coils are formed. The rate of change of flux induces electric currents to flow in closed, electrically conductive paths enclosing the flux. Where coiled tubes enclose changing flux, currents flowing in the tubes heat the tubes, thereby tending to defeat their capability to provide for effective cooling. Moreover, the coiled tubes are typically connected to an exterior water supply, such as a recirculating chiller or facility water supply, and induced voltages may couple to these facilities exposing persons to danger. Where coiled tubes are wound in a similar manner and orientation to the windings of the electric coils, maximum induced voltages and currents are produced.

To reduce the induced voltages, the cooling coils may be wrapped in one direction over a part of the coil and in the other direction over a geometrically symmetrical part of the coil, so that induced voltages oppose one another and cancel out. However, where there are remaining asymmetries in the magnetic properties of the flux path, such as those introduced by the part that is being magnetized as a result of asymmetric properties or of the placement of the part within the coil, cancellation of the induced voltages is not complete.

Turning to considerations of the electric coil, individual coils thereof are typically formed around a tubular form or bobbin. The material of which the electric coils are formed will typically be provided with a large cross-sectional area for conducting large currents with low resistance. However, where the coils are formed by bending straight material around the bobbin, the bending force required will be greater for a greater cross-sectional area. This is especially so for material that is substantially radially symmetric in cross-section, such as ordinary round wire, where the bending moment of inertia for the cross-section increases with increasing cross-sectional area.

Yet another problem encountered in the design of coils for magnetizing an article is that the field inside the coil is typically not uniform. The field varies radially in relation to distance away from the center axis of the coil, being less at the center for a uniformly wound coil of finite length. Where the field inside the coil is not uniform, a greater current must be carried by the electric coil in order for producing a greater field, to ensure that the field everywhere equals or exceeds that required to provide the necessary coercive force. To the extent that the field must be increased because of its nonuniformity, the problems described above are exacerbated.

Accordingly, there is a need for a coil for magnetizing an article that provides for improved cost and ease of manufacture of an electric coil for generating a large magnetic field, that provides for more effective removal of heat from the coil while maintaining sufficient strength in the coil to resist magnetically induced stresses and while reducing or eliminating induced voltages and eddy currents in electrically conductive cooling apparatus, and that decreases the current carrying requirements of the electric coil to achieve the required magnetic field.

SUMMARY OF THE INVENTION

The coil and method for magnetizing an article of the present invention solves the aforementioned problems and meets the aforementioned needs by providing a cooling coil component and an electric coil component in a coil having an elongate axis. The electric coil component is formed of an elongate material and is placed with its center along a bobbin. One end of the material is wound in one direction around the bobbin and the other end is wound in the other direction around the bobbin. The material is formed with an offset equal to or greater than the axial width thereof, avoiding the need to wind the material in a helix.

The cooling coil component includes a disk-like member in which a passage is formed for carrying a fluid coolant. The disk-like member is preferably "C" shaped to prevent the flow of eddy currents. The passage is formed as a loop that extends around the coil, the loop stopping short of extending a full 360 degrees around the coil. The passage then reverses and returns around the coil in the other direction.

Preferably a plurality of electric coil components and cooling coil components are employed in the coil in alternating sequence. Alternating cooling coil components employ passages that are formed in loops extending in opposite directions, such as by being mirror images of one another.

Electric coil components disposeu at the ends of the coil are provided with a greater number of windings to make the magnetic field in the coil more uniform in both the axial and radial directions.

Therefore, it is a principal object of the present invention to provide a novel and improved coil and method for magnetizing an article.

It is another object of the present invention to provide a coil and method that provides for improved cost and ease of manufacture of an electric coil for generating a large magnetic field.

It is yet another object of the present invention to provide a coil and method that provides for more effective removal of heat from the coil.

It is still another object of the present invention to provide a coil and method that provides for such effective heat removal while maintaining sufficient strength in the coil to resist magnetically induced stresses.

It is a further object of the present invention to provide a coil and method that provides for such effective heat removal while reducing or eliminating induced voltages and eddy currents in electrically conductive cooling apparatus.

It is yet a further object of the present invention to provide a coil and method that provides for decreased current carrying requirements of the electric coil to achieve the required magnetic field.

The foregoing and other objects, features and advantages of the present invention will be more readily understood upon consideration of the following detailed description of the invention, taken in conjunction with the following drawings.

BRIEF DESCRIPTION OF THE DRAWINGS

FIG. 2 is a plan view of one of the cooling coil components of the coil of FIG. 1, taken along a line 2—2 thereof.

FIG. 3 is a plan view of the other of the cooling coil components of the coil of FIG. 1, taken along a line 3—3 thereof.

DETAILED DESCRIPTION OF A PREFERRED EMBODIMENT

Figure 1:
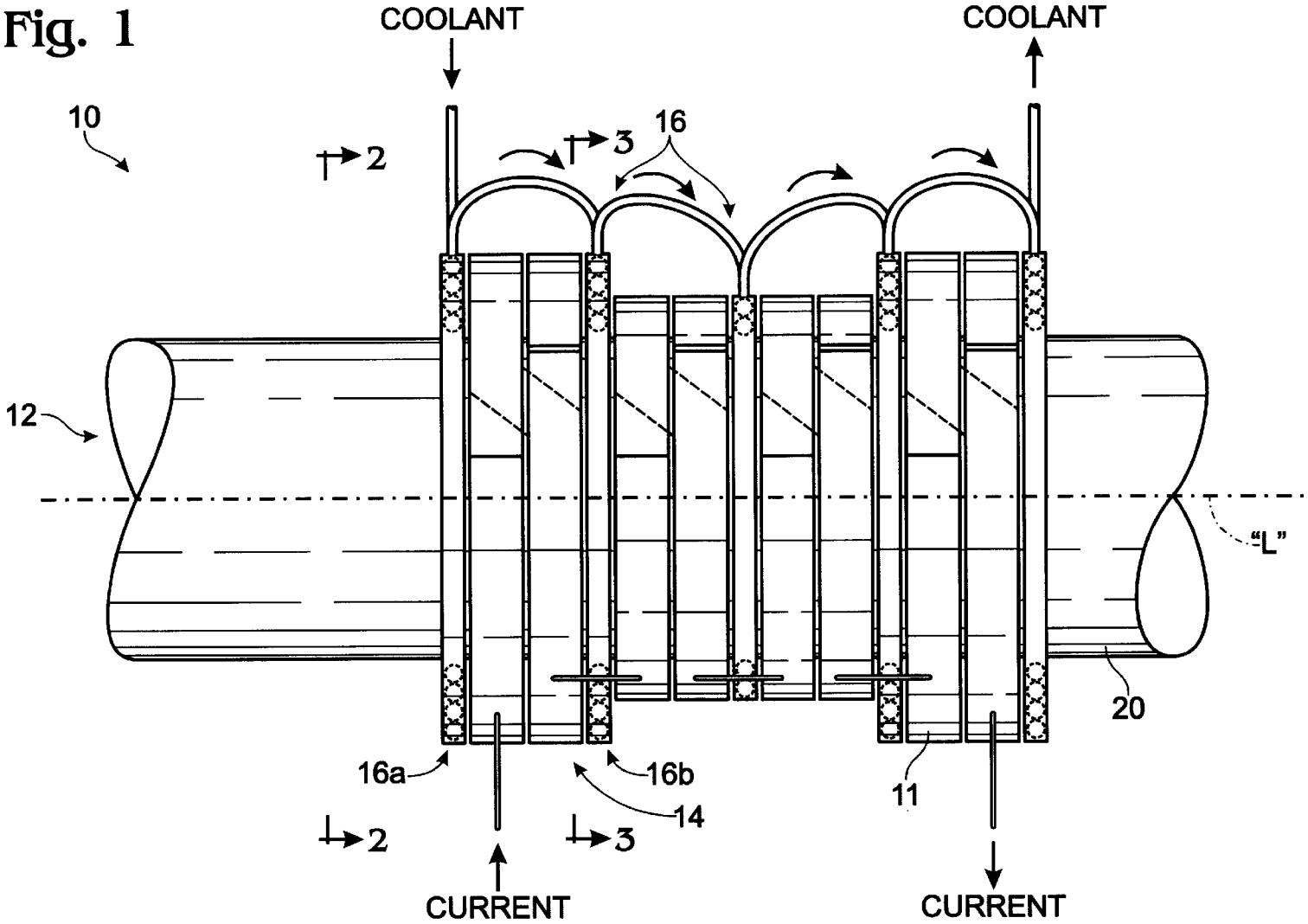
FIG. 1 is a side elevation of a coil for magnetizing an article showing cooling coil components and electric coil components according to the present invention.

Referring to FIG. 1, a preferred embodiment of a coil 10 for magnetizing an article according to the present invention is shown. A conductive material 11 is wrapped around a bobbin 20. The coil 10 is typically cylindrical and has an elongate axis "L," though other coil shapes and configurations could be used with suitable modification of the components described below. An electrical potential is impressed across the conductive elements and a current flows through the conductive material, around the coil. This generates a magnetic field in accord with Ampere's Rule.

An article to be magnetized (not shown) is placed within the space 12 inside the coil. The electrical potential and the conductance of the material 11 is selected to produce a magnetic field that exceeds the required coercive force for the article.

The coil 10 according to the present invention preferably provides for modular manufacturing and assembly by employing modules of electric coil components 14 and cooling coil components 16. One or more of each are assembled together to form the coil 10. Particularly, cooling coil components are disposed in alternating sequence with electric coil components along the axis "L", so that a cooling coil component is disposed axially adjacent an electric coil component, so as to be in contact with sides thereof, for conducting heat axially in the direction of the axis "L" rather than radially. This permits applying a supporting structure around the circumference of the electric coil to resist the aforementioned Lorentz stress without hindering the transfer of heat from the electric coil components to the cooling coil components. This also provides a much greater surface area available for cooling than has been provided in the prior art.

Referring in addition to FIGS. 2 and 3, the cooling coil components 16 are formed of tubing 17 adapted for carrying a coolant such as, for example, water, oil, alcohol or freon. The tubing is typically formed of copper for good thermal conductivity. The tubing 17 is embedded in a disk-like member 19. The disk-like member 19 generally conforms in shape to the coil 10 and may have other shapes for coils having other shapes. The disk-like member 19 has a central aperture 21 that corresponds to the bobbin 20 and extends radially outwardly to an outer circumference 23. The disk-like member is disposed on the coil so that the plane of the disk-like member extends perpendicular to, i.e., is "square" with the longitudinal axis "L", extending radially from the aperture 21. The disk-like member is also thermally conductive, and is preferably formed of a metal having a lower melting point than the material of which the tubing 17 is formed. Then, the tubing may be cast into the disk-like member. The disk-like member may also be formed of an epoxy with thermally conductive particles embedded therein, such as particles of metal or metallic oxide.

The disk-like member 19 includes a side aperture 25 that extends radially from the central aperture 21 all the way through the disk-like member, from the central aperture 21 to the outer circumference 23, so that the disk-like member has substantially a "C" shape. This forms a radial line of termination 26 breaking the conductive path around the disk-like member, substantially preventing the flow of eddy currents therein. The tubing 17 extends partially but not entirely around the aperture 21, stopping short of extending, in the plane of the Figure, around the aperture a full 360 degrees. Referring particularly to FIGS. 2 and 3, the tubing 17 preferably enters the disk-like member at a first end 27*a* at a location 29 along the circumference 23, is looped around the central aperture 21 short of reaching the side aperture 25, is bent about 180 degrees and follows closely the same loop back around the central aperture 21 to about the location 29, where the tubing exits the disk-like member at a second end 27*b*.

As it is preferable to provide a number of the cooling elements 16, to increase cooling and to further decrease the possibility of linking magnetic flux with the corresponding disk-like members 19, the tubing 17 of sequentially disposed disk-like members are preferably disposed as mirror images of one another, so that remaining induced voltages in the disk-like members 19 tend to be cancelled out. For example, compare FIG. 2 and FIG. 3. The combination of providing a small loop area in the tubing 17 and arranging the loops of sequentially disposed disk-like members as mirror images of one another provides for a better cancellation of induced voltage than would either technique alone.

The ends 27*a* and 27*b* of the tubing 17 are connected to respective manifolds (not shown) for supply and discharge of the coolant. To improve heat transfer from the electric coil components 14 to the cooling coil components 16, both the electric coil components and the cooling coil components form modules having sides that are square with the longitudinal axis "L", so that the sides of axially adjacent components may be placed intimately against one another when the coil is assembled.

The electric coil components 14 may be formed as is typical in the art, such as by providing a length of electrically insulated, electrically conductive wire and winding the wire around a cylindrical form or bobbin. However, as the wire is made larger in order that it have the capacity to carry larger currents and, therefore, may produce larger magnetic fields, it is more difficult to bend. The force required to bend the wire is proportional to the dimension of the wire that lies in a direction perpendicular to the direction of bending, such as the axial direction for a wire wound around the bobbin 20. Worse, the force required to bend the wire in the direction of bending, i.e., the radial direction, is proportional to the dimension of the wire in that direction raised to the third power. Therefore, where the wire or other material is substantially radially symmetric, relatively thick and strong, such as the metal wire employed in magnetizing apparatus, it is particularly difficult to bend. Preferably, the electric coil elements 14 employ a wire or other length of conductive material that has a cross-sectional area that, for a given size, has a relatively larger axial dimension and a relatively smaller radial dimension.

Figure 4:
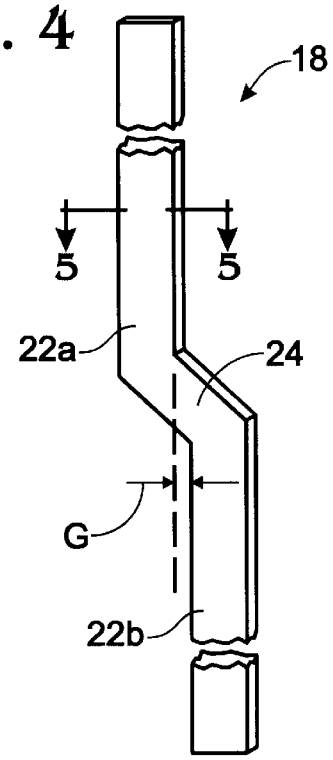
FIG. 4 is a plan view of a strip material portion corresponding to one of the electric coil components of FIG. 1.
Figure 5:
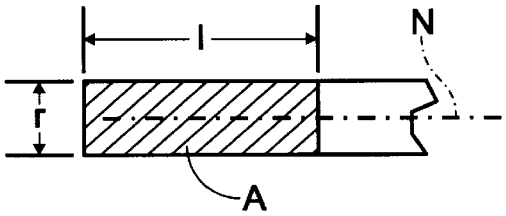
FIG. 5 is a cross-sectional view of the strip material portion of FIG. 4, taken along a line 5—5 thereof.

With reference to FIGS. 4 and 5, the invention provides strip material portions 18 as the electric coil components. The strip material portions have a cross-section having an axial dimension "1" that is greater than a radial dimension "r", with respect to the corresponding axes "L" and "R" of a cylindrical bobbin 20, the cross-sectional area "A" being the product (1·r) and being selected as practical for decreasing the electrical resistance of the electric coil components 14. To wind the strip material portions 18 around the bobbin 20, the strip material is bent so that a neutral axis "N" of the cross-sectional area "A" results. The neutral axis defines the line above which material is in tension and below which material is in compression as a result of the bending force. The bobbin 20 may or may not remain as part of the coil, as desired.

In typical prior art windings of electric coils, the wire is wound so as to form a helix so that the wire makes an angle with the perpendicular to the elongate axis. This results in wasted space where the tails of the wire enter and exit the coil, and where the helical angle is reversed for multiple layers of windings. By contrast, the present invention avoids the need to apply the strip material portions 18 to the bobbin 24 at a helical angle, and therefore avoids wasted space and modularizes the components 14 and 16. Referring to FIG. 4, this is accomplished by providing in the strip material 18 two substantially parallel, linear end sections 22*a* and 22*b* connected by associated offsetting sections 24.

Figure 6A:
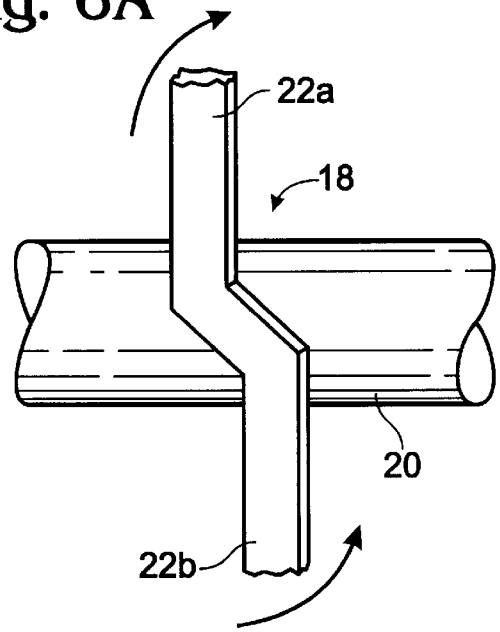
FIG. 6A is a side elevation of the strip material portion of FIG. 4 readied for winding to form one of the electric coil components of FIG. 1.
Figure 6B:
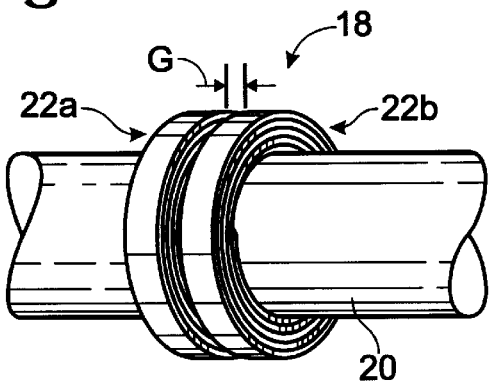
FIG. 6B is a side elevation of the strip material portion of FIG. 4 after the winding of FIG. 6A.

Referring to FIGS. 6A and 6B, the offsetting sections laterally or axially offset the end sections from one another so that each end section may be wound around the bobbin 20 independently of the other end section. Particularly, the offsetting section is placed against the bobbin so that one of the end sections extends upwardly and one of the ends extends downwardly with respect to a horizontally disposed longitudinal axis "L". The ends are both wound around the bobbin so that each end forms a spiral of radially adjacent turns extending from the bobbin 20 radially outwardly. One of the end sections 22*a* and 22*b* is wound clockwise around the bobbin and the other is wound counter-clockwise; however, the strip 18 considered continuously from one end section to the other is seen to be wound in a single direction. Where the mid-point of the strip 18 corresponds to the offsetting section, the end sections provide equal numbers of turns.

The amount of lateral offset of the offsetting section is adapted to ensure th at the end sections, when so wound, lie parallel and substantially adjacent one another. A thin layer of electrical insulation is applied to the strip material 18 so that the radially adjacent turns do not form short circuits. Preferably as well, the offsetting section provides a small gap "G" between the wound end sections to provide room for an additional layer of insulation insulating the end sections from one another, where the difference in potential between one layer of one of the end sections to an adjacent layer of the other end section may be much larger.

However, the aforedescribed electric coil functions in conjunction with the aforedescribed cooling coil configuration to provide for a further advantage in cooling over the prior art. The electrical insulation imposes a significant barrier to heat flow. Typically in prior art coils, windings are buried within the coil among a number of other windings and heat must flow through a number of windings, including their insulation, to reach the surface of the coil where the heat can be removed. It is one aspect of the present invention to provide a layered spiral of radially adjacent turns of the electric coil having turns abutting a cooling coil. Thence, heat is only required to flow through one layer of insulation to reach a heat sink.

Figure 7A:
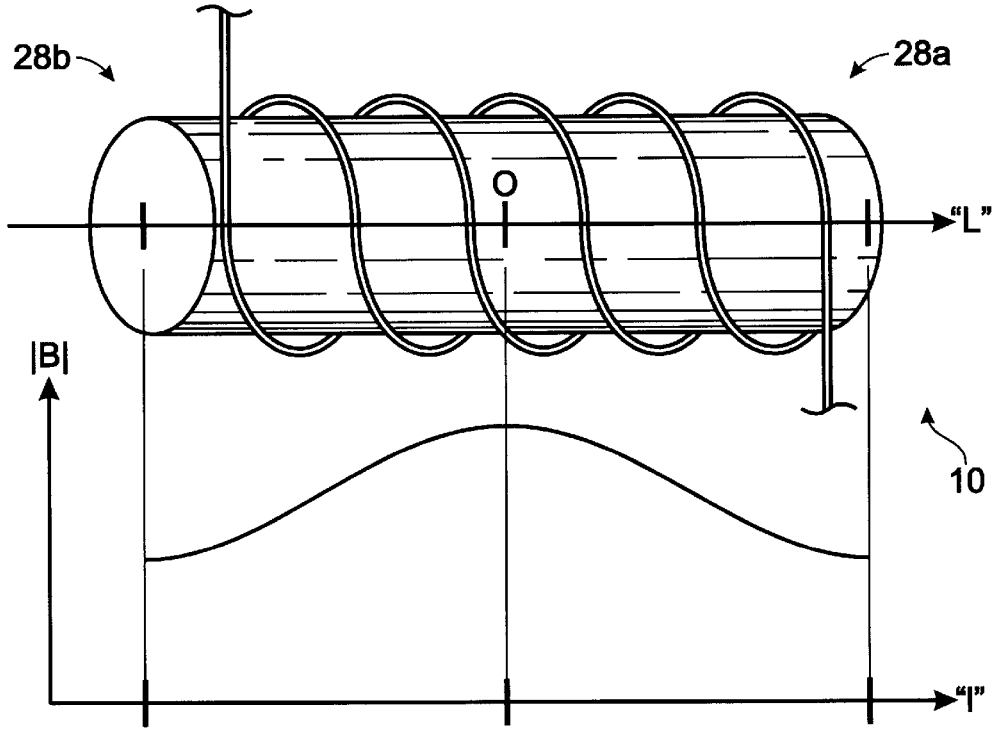
Fig. 7A (PRIOR ART)
FIG. 7A is a graph of the axial dependence of the magnetic field inside a typical prior art electromagnetic coil.
Figure 7B:
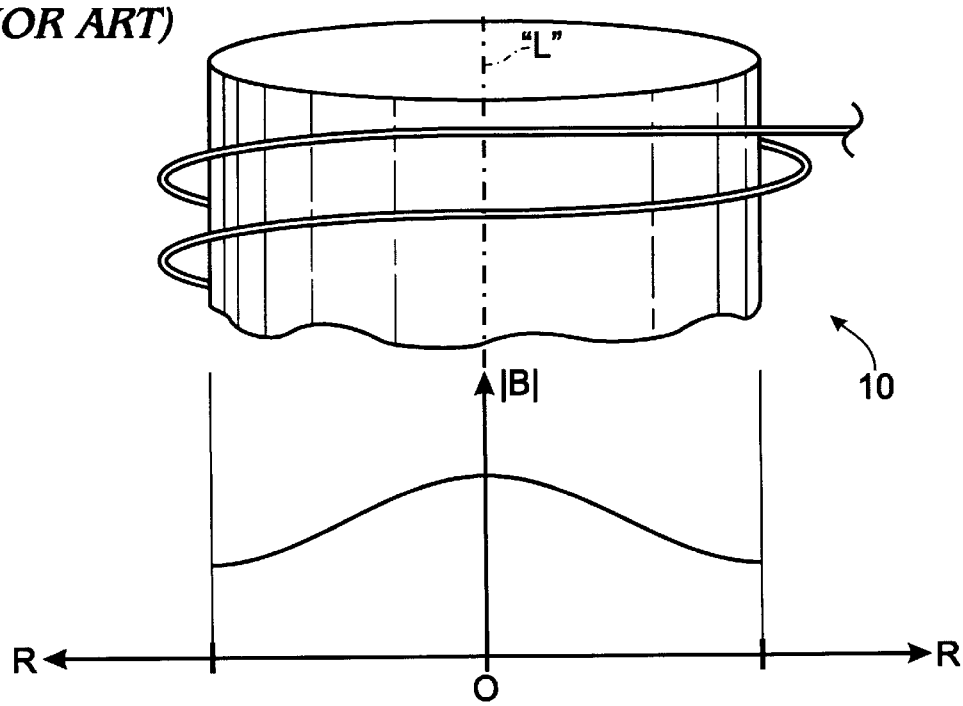
Fig. 7B (PRIOR ART)
FIG. 7B is a graph of the radial dependence of the magnetic field inside a typical prior art electromagnetic coil.

Turning to another aspect of the invention, in the typical, non-ideal and non-infinitely long electromagnetic coil, the magnetic field inside the coil does not have a uniform strength. Referring to FIGS. 7A and 7B respectively, the magnitude of the magnetic field "B" decreases both axially from the center "o" of the coil and radially from the axis "L". To magnetize the entire article, a predetermined coercive force and consequent minimum magnetic field must be applied through the entire article. Therefore, to ensure that a minimum field is produced everywhere inside the coil, the field must generally be increased to compensate for the aforementioned reductions. The typical manner of achieving this compensation is simply to increase the current in the coil, to increase the field everywhere inside the coil. However, as discussed earlier, it is highly desirable to minimize the amount of electric current required to produce a magnetic field sufficient to magnetize the entire article.

It is desirable, then, to compensate for the loss in the field locally, so that the field is made more uniform rather than simply being increased overall. It is apparent that the field can be made more uniform in the axial direction simply by increasing the number of turns of the electric coil at the ends. Moreover, the present inventor has recognized that the same means for making the field more uniform with respect to axial variations also operates to make the field more uniform with respect to radial variations. This is seen from the fact that the field inside the coil is governed by LaPlace's equation:

$\nabla^2\phi=0$, where $\phi$ is the magnetic potential.

Then, $$\frac{\partial^2\phi}{\partial x^2}+\frac{\partial^2\phi}{\partial y^2}+\frac{\partial^2\phi}{\partial z^2}=0.$$

Since $$\vec{B}=\left(\frac{\partial\phi}{\partial x}\hat{x},+\frac{\partial\phi}{\partial y}\hat{y},+\frac{\partial\phi}{\partial z}\hat{z}\right),$$

$$\frac{\partial B_x}{\partial x}+\frac{\partial B_y}{\partial y}+\frac{\partial B_z}{\partial z}=0.$$

Assuming an action that makes the field uniform along the z direction, i.e., $$\frac{\partial B_z}{\partial z}=0.$$

Then, $$\frac{\partial B_x}{\partial x}+\frac{\partial B_y}{\partial y}=0.$$

Therefore, $$\frac{\partial B_x}{\partial x}=\frac{\partial B_y}{\partial y}$$

By symmetry, the only way this can be true is for both $\partial B_x/\partial x$ and $\partial B_y/\partial y$ to equal zero. Therefore, it can be seen that to make the magnetic field inside the coil 10 more uniform both with respect to axial and radial variations, more turns should be provided in the electric coil components 14 nearer the ends of the coil 10.

It is to be recognized that, while a specific coil for magnetizing an article and method have been shown and described as preferred, other configurations could be utilized, in addition to configurations already mentioned, without departing from the principles of the invention. For example, where the invention as pertaining in particular to a cylindrical coil has been shown and described, the invention may be employed in a toroidal or other coil configuration, or in a coil having a cross-sectional shape that differs from a circle, without departing from the principles of the invention.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

We claim:

1. A magnetizing apparatus for magnetizing an article, comprising:

an electric coil component having an axis defining a direction along which said component is adapted to produce a magnetic flux inside said component; and a first cooling coil component adapted for carrying a fluid coolant, at least a portion of said first cooling coil begin disposed to lie axially adjacent a first side of said electric coil component in physical contact therewith over at least a portion thereof, said first cooling coil component being configured to loop partially but not entirely around said axis.

2. The magnetizing apparatus of claim 1, wherein said first cooling coil component is formed of a thermally conductive material and includes a passage for conducting said coolant, said passage extending from a location on said first cooling coil component in a selected one of the clockwise and counterclockwise directions to a first point of turn-around short of 360 degrees around said axis from said location, said passage at said first point turning reversedly in the other of the clockwise and counterclockwise directions.

3. The magnetizing apparatus of claim 1, wherein said first cooling coil component includes a thermally conductive support substrate which is "C" shaped for terminating said path.

4. The coil of claim 3, wherein said cooling coil component includes a length of hollow metal tubing embedded in said support substrate.

5. The magnetizing apparatus of claim 4, wherein said hollow tubing is formed of a metal, and wherein said support substrate is formed of a metal having a lower melting point than said metal of said hollow tubing.

6. The magnetizing apparatus of claim 4, wherein said support substrate is formed of an epoxy having thermally conductive particles distributed therein.

7. The magnetizing apparatus of claim 2, further comprising a second cooling coil component for carrying said coolant, at least a portion of which is disposed to lie axially adjacent a second side of said electric coil component in physical contact therewith over at least a portion thereof, said second cooling coil component being formed of a thermally conductive material and including a passage for conducting said coolant, said passage of said second cooling coil component extending from a location on said second coil component in the other of the clockwise and counterclockwise directions to a second point of turn-around short of 360 degrees around said axis from said location on said second cooling coil component, said passage of said second cooling coil component at said second point turning reversedly in said selected one of the clockwise and counterclockwise directions.

8. The magnetizing apparatus of claim 1, wherein the elongate axis of the coil defines a radial direction perpendicular thereto, wherein said electric coil component has a first and second radial winding connected by a laterally offsetting portion, said first radial winding commencing from a first end of said laterally offsetting portion and radially winding outwardly around the elongate axis in one of the clockwise and counterclockwise directions, said second radial winding commencing from a second end of said laterally offsetting portion and radially winding outwardly around the elongate axis in the other of the clockwise and counterclockwise directions, wherein said laterally offsetting portion laterally offsets, along the elongate axis, said first radial winding and said second radial winding so that said windings do not interfere with one another.

9. The magnetizing apparatus of claim 8, wherein said laterally offsetting portion is adapted to space said first and said second radial windings so that a relatively small gap is formed for receiving a layer of insulating material.

10. The magnetizing apparatus of claim 8, wherein said electric coil component includes a single strip of material having two ends corresponding to said first and second radial windings, wherein a mid-point of said strip of material between said ends corresponds to said laterally offsetting portion.

11. The magnetizing apparatus of claim 10, wherein said ends of said strip material have a cross-section that, as wound to form said first and second radial windings, has a radial dimension and an axial dimension that is substantially greater than said radial dimension.

12. The magnetizing apparatus of claim 1, wherein the coil has two ends and a middle portion, wherein said electric coil component comprises a plurality of windings of an elongate electrically conductive material, said windings being distributed axially across said coil component and having a first turns density across said middle portion, wherein said windings have a second turns density at said two ends that is substantially greater than said first turns density.

* * * * *